US008240248B2

(12) United States Patent
Toyama

(10) Patent No.: US 8,240,248 B2
(45) Date of Patent: Aug. 14, 2012

(54) ENDLESS PRINTING BELT

(75) Inventor: Yasuhiro Toyama, Gamagohri (JP)

(73) Assignee: Yamahachi Kemikaru Kabushiki Kaisha (JP)

( * ) Notice: Subject to any disclaimer, the term of this patent is extended or adjusted under 35 U.S.C. 154(b) by 972 days.

(21) Appl. No.: 12/252,519

(22) Filed: Oct. 16, 2008

(65) Prior Publication Data

US 2009/0107351 A1 Apr. 30, 2009

(30) Foreign Application Priority Data

Oct. 30, 2007 (JP) ..... 2007-281414

(51) Int. Cl.
*B41J 1/20* (2006.01)

(52) U.S. Cl. ..... 101/111; 101/105; 101/327; 101/368

(58) Field of Classification Search ..... 101/111
See application file for complete search history.

(56) References Cited

U.S. PATENT DOCUMENTS 2,598,806 A * 6/1952 Lauer ..... 101/103
4,119,029 A * 10/1978 McMillan et al. ..... 101/111
4,119,030 A * 10/1978 Funahashi ..... 101/111
5,799,576 A * 9/1998 Koike et al. ..... 101/111
7,954,427 B2 * 6/2011 Ishikawa et al. ..... 101/111
2008/0236416 A1 * 10/2008 Ishikawa et al. ..... 101/111

FOREIGN PATENT DOCUMENTS

| | | |
|---|---|---|
| JP | 11129595 | 5/1999 |
| JP | 11129596 | 5/1999 |
| JP | 2005205798 | 8/2005 |
| JP | 2005297461 | 10/2005 |

* cited by examiner

*Primary Examiner* — Jill Culler
(74) *Attorney, Agent, or Firm* — Price Heneveld LLP

(57) ABSTRACT

Provided is an endless printing belt which is capable of reducing ink leakage from a back surface, reducing a loss of ink due to volatilization in the case of applying volatile ink, ensuring a smooth feeding action of the printing belt to achieve accurate positioning of a printing portion, and enhancing belt strength so as to suppress deformation of the belt.

In an endless printing belt mainly made of thermoplastic resin provided with interconnected cells, a surface of the belt constitutes a surface for a printing surface, a side surface is rendered ink-impermeable, and a back surface of the belt includes an ink-impermeable portion and an ink-permeable portion.

7 Claims, 4 Drawing Sheets

ENDLESS PRINTING BELT

CROSS-REFERENCE TO RELATED APPLICATION

This application claims priority to Japanese Patent Application No. 2007-281414 filed on Oct. 30, 2007.

TECHNICAL FIELD

The present invention relates to an endless printing belt which is made of a porous thermoplastic resin material having interconnected cells and is used for a rotary stamp by impregnating the resin material with ink.

BACKGROUND OF THE INVENTION

Endless printing belts prepared by forming a base and a printing portion on a resin sheet of a certain type and impregnating the printing portion with ink for application to a rotary stamp have been publicly known (see Japanese Patent Application Publication Nos. 11-129595 and 11-129596, for example).

Similarly, endless printing belts prepared by forming a printing portion on a resin sheet and impregnating the printing portion with ink, and then subjecting side surfaces of the belt to melt-solidification for application to a rotary stamp have also been publicly known (see Japanese Patent Application Publication Nos. 2005-205798 and 2005-297461, for example).

The prior art according to Japanese Patent Application Publication Nos. 11-129595 and 11-129596 typically has a configuration to use a hot-melt sheet as a base material, to form a back-surface into a flat surface, and to render the entire surface ink-permeable. Moreover, this prior art also includes a configuration to use a non-porous sheet as the base material. Here, the back surface is formed into a flat surface as well.

Meanwhile, the prior art according to Japanese Patent Application Publication Nos. 2005-205798 and 2005-297461 has a configuration to apply a base fabric-attached porous stamp material using a base fabric such as a woven fabric or a nonwoven fabric, to form a back surface into a flat surface, and to render an entire surface ink-permeable. Here, side surfaces of the stamp material are subjected to melt-solidification.

These examples of the prior art have the following problems. Specifically, the one configured to render the back surface ink-permeable causes ink leakage from the back surface. In particular, when volatile-ink is used therein, these examples cause a loss of ink due to volatilization. Moreover, since the back surface is formed into a flat surface, a slipping action is caused when feeding the endless printing belt and a reliable feeding action is thereby complicated. As a consequence, it is difficult to position a printing portion accurately.

SUMMARY OF THE INVENTION

In view of the foregoing problems, an aspect of the present invention is to provide a novel endless printing belt which is capable of reducing ink leakage from a back surface, reducing a loss of ink due to volatilization in the case of applying volatile ink, ensuring a smooth feeding action of the printing belt to achieve accurate positioning of a printing portion, and enhancing belt strength so as to suppress deformation of the belt.

An aspect of an endless printing belt of an embodiment of the present invention is to provide an endless printing belt mainly made of thermoplastic resin provided with interconnected cells, in which a surface of the belt constitutes a surface used for a printing surface, a side surface is rendered ink-impermeable, and a back surface of the belt includes an ink-impermeable portion and an ink-permeable portion.

The printing belt of an embodiment of the present invention includes an ink-permeable printing portion formed on the surface used for the printing surface.

Meanwhile, the printing belt of an embodiment of the present invention does not include a printing portion on the surface used for the printing surface.

Moreover, in the endless printing belt of the present invention, the ink-impermeable portion on the back surface of the belt comprises a concave portion in any of a line shape and a plane shape located substantially perpendicular to a longitudinal direction of the belt, the ink-permeable portion between the ink-impermeable portions comprises a convex portion, the back surface of the belt is formed into an irregular shape, and the convex portion and the concave portion on the back surface of the belt exert a slip prevention function when feeding the belt.

Meanwhile, in the endless printing belt of an embodiment of the present invention, an area of the ink-impermeable portions on the back surface of the belt is set in a range from 30% to 70% relative to the entire back surface of the belt.

Moreover, in the endless printing belt of an embodiment of the present invention, the thermoplastic resin applies a polyolefin polymer compound having a softening point equal to or below 100° C.

In an embodiment of the present invention, a woven fabric or a nonwoven fabric having fine dimensional stability is used when interposing a sheet material between the surface and the back surface of the belt. Here, it is preferable to use a thin woven fabric.

Meanwhile, the type of fibers used therein is not particularly limited. It is possible to use the sheet material formed of a single material or a blended material of filaments or staples selected from fibers including polyester, polyamide, acryl, cellulose, polyolefin, and the like.

A method of integrating the surface portion of the belt, the back surface portion thereof, and the sheet material together is not particularly limited. For example, it is possible to interpose the sheet material between a resin body constituting the surface portion of the belt and a resin body constituting the back surface portion of the belt and to heat and press these constituents together. Alternatively, it is possible to integrate the constituents by extrusion-molding the resin body constituting the surface portion and the resin body constituting the back surface portion while interposing the sheet material therebetween at the same time.

The endless printing belt of an embodiment of the present invention is the endless printing belt mainly made of the thermoplastic resin provided with the interconnected cells, in which the surface of the belt comprises the surface used for the printing surface, the side surface is rendered ink-impermeable, and the back surface of the belt includes the ink-impermeable portion and the ink-permeable portion. Accordingly, it is possible to reduce ink leakage from the back surface. Moreover, in the case of using volatile ink, it is possible to reduce a loss of the ink due to volatilization.

The endless printing belt of an embodiment of the present invention includes the ink-permeable printing portion formed on the surface used for the printing surface. Accordingly, it is possible to provide the endless printing belt having the printing portion formed in advance on the surface used for the printing surface.

Meanwhile, the endless printing belt of an embodiment of the present invention does not include a printing portion on the surface used for the printing surface. Accordingly, a purchaser can assign a retail shop to form printing portions later while using desirable characters, designs, and so forth.

According to the endless printing belt of an embodiment of the present invention, the ink-impermeable portion on the back surface of the belt comprises the concave portion in any of a line shape and a plane shape located substantially perpendicular to the longitudinal direction of the belt, the ink-permeable portion between the ink-impermeable portions comprises the convex portion, the back surface of the belt is formed into the irregular shape, and the convex portion and the concave portion on the back surface of the belt exert the slip prevention function when feeding the belt. Therefore, the concave portion and the convex portion on the back surface of the belt increase the strength of the belt and suppress loosening, i.e., deformation of the belt owing to stress. Moreover, the irregular shape on the back surface of the belt not only smoothes a feeding action of the belt but also ensures positioning of the printing portion.

Moreover, in the endless printing belt of an embodiment of the present invention, the thermoplastic resin applies a polyolefin polymer compound having a softening point equal to or below 100° C. Accordingly, it is possible to form the ink-impermeable portion easily and to improve processing accuracy by use of the thermoplastic material having a low melting point.

By using the sheet material made of a woven fabric or the like inside the endless printing belt of an embodiment of the present invention, it is possible to improve dimensional stability of the belt as a whole. Although an embodiment of the present invention has excellent dimensional stability without using such a sheet material, it is still possible to locate the sheet material inside in the case of a large-sized or long endless printing belt which is expected to satisfy a high degree of dimensional stability.

A method of forming a sheet having interconnected cells constituting a foundation of an endless printing belt of an embodiment of the present invention is similar to publicly-known techniques. However, the present invention has the following characteristic features. Specifically, thermoplastic resin, or more specifically, polyolefin resin having a softening point preferably equal to or below 100° C., or more preferably equal to or below 80° C., is used as a principal material. Moreover, any of a water-soluble material or a compound which is rendered water-soluble by way of a chemical treatment, including various water-soluble inorganic salts, compounds which can be rendered water-soluble by an acidic treatment (such as calcium carbonate), and organic polymer compounds including PVA, alginic acid, sucrose, and the like is used as a first submaterial. Further, a water-soluble compound either having a liquid state or having a low melting point is used as a second submaterial to help blending and melting of the main material and the submaterials. Such a second submaterial may be any of ethylene glycol, polyethylene glycol, propylene glycol, polypropylene glycol, glycerin, a copolymer of ethylene glycol and propylene glycol, or an alcohol, for example. In addition, a pigment, a stabilizing agent or the like is used as a third submaterial.

Meanwhile, a method of forming a printing surface may apply a negative printing method using infrared rays, ultraviolet rays or the like, or utilization of a heat plate provided with irregularities, for example. However, the forming method is not particularly limited herein.

In addition, a method of preventing ink leakage from a side surface, a method of forming an irregular shape on a back surface, and a method of forming an endless shape basically apply fusion bonding of the resin achieved by means of direct contact to a heater. However, concrete methods thereof are not particularly limited.

A woven fabric or a nonwoven fabric having fine dimensional stability is applied when interposing a sheet material between the surface of the belt and the back surface thereof. Here, a thin woven fabric can be used.

Here, the type of fibers used therein is not particularly limited. It is possible to use the sheet material formed of a single material or a blended material of filaments or staples selected from fibers including polyester, polyamide, acryl, cellulose, polyolefin, and the like.

A method of integrating the surface portion of the belt, the back surface portion thereof, and the sheet material together is not particularly limited. For example, it is possible to interpose the sheet material between a resin body constituting the surface portion of the belt and a resin body constituting the back surface portion of the belt, and to heat and press these constituents. Alternatively, it is possible to integrate the constituents by extrusion-molding the resin body constituting the surface portion and the resin body constituting the back surface portion while interposing the sheet material therebetween at the same time.

DETAILED DESCRIPTION OF AN EMBODIMENT OF THE INVENTION

Figure 1:
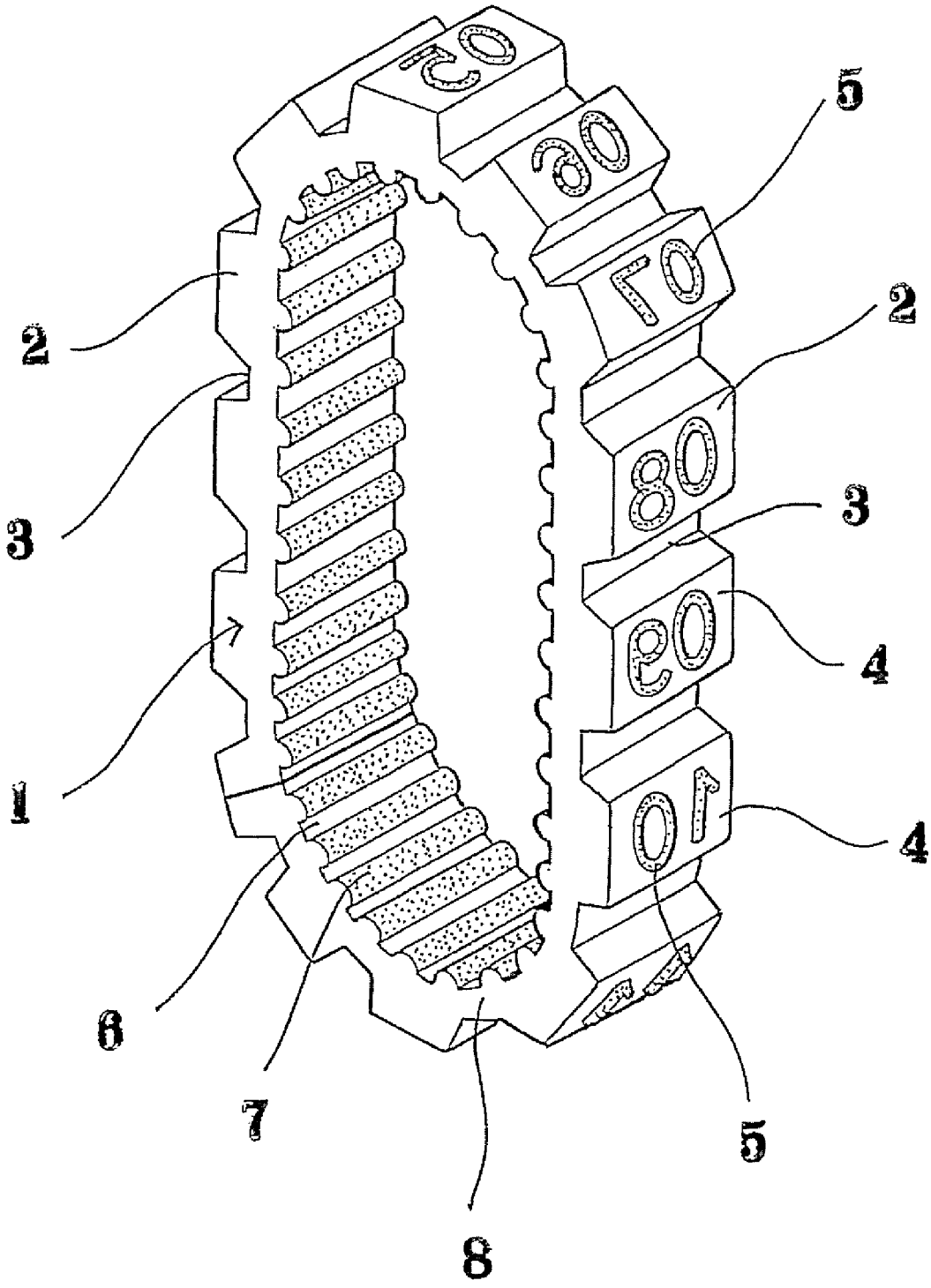
FIG. 1 is a perspective view of an endless printing belt according to an aspect of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
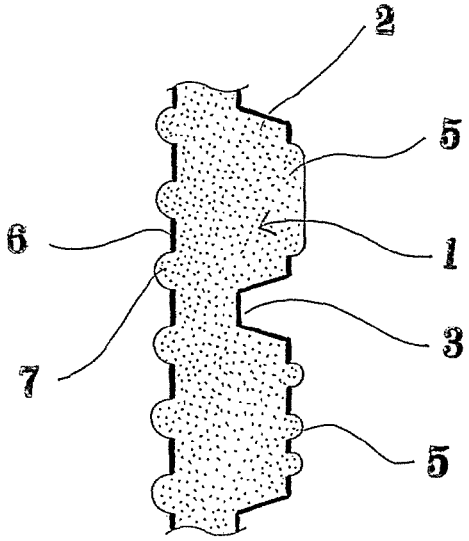
FIG. 3 is a partial cross-sectional view of the endless printing belt shown in FIG. 1 which is taken along a longitudinal direction of the belt.
Figure 5:
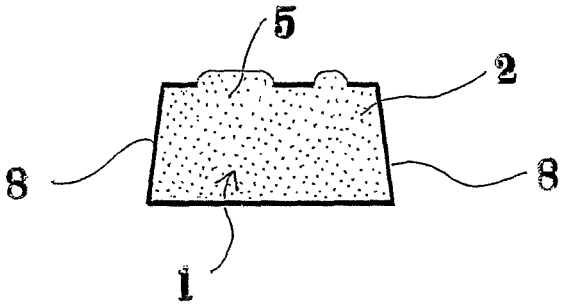
FIG. 5 is a cross-sectional view of the endless printing belt shown in FIG. 1 which is taken along a perpendicular direction to the longitudinal direction of the belt.

FIGS. 1, 3, and 5 show an endless printing belt of an embodiment of the present invention. FIG. 1 shows a perspective view of the endless printing belt. FIG. 3 shows a partial cross-sectional view taken along a longitudinal direction of the belt. FIG. 5 shows a cross-sectional view taken along a perpendicular direction to the longitudinal direction of the endless printing belt. Meanwhile, FIG. 6 shows a partial cross-sectional view of an endless printing belt, which interposes and integrates the sheet material.

In the drawings, reference numeral 1 denotes a belt body of the endless printing belt mainly made of thermoplastic resin provided with interconnected cells. Convex portions 2 and concave portions 3 are continuously formed on a surface thereof. Here, a surface of each of the convex portions 2 is defined as a surface 4 used for a printing surface. Both side surfaces 8 of this belt body 1 constitute ink-impermeable portions. In the endless printing belt shown in FIGS. 1, 3, and 5, ink-permeable character portions 5 are provided on the surfaces 4 used for the printing surfaces.

Figure 2:
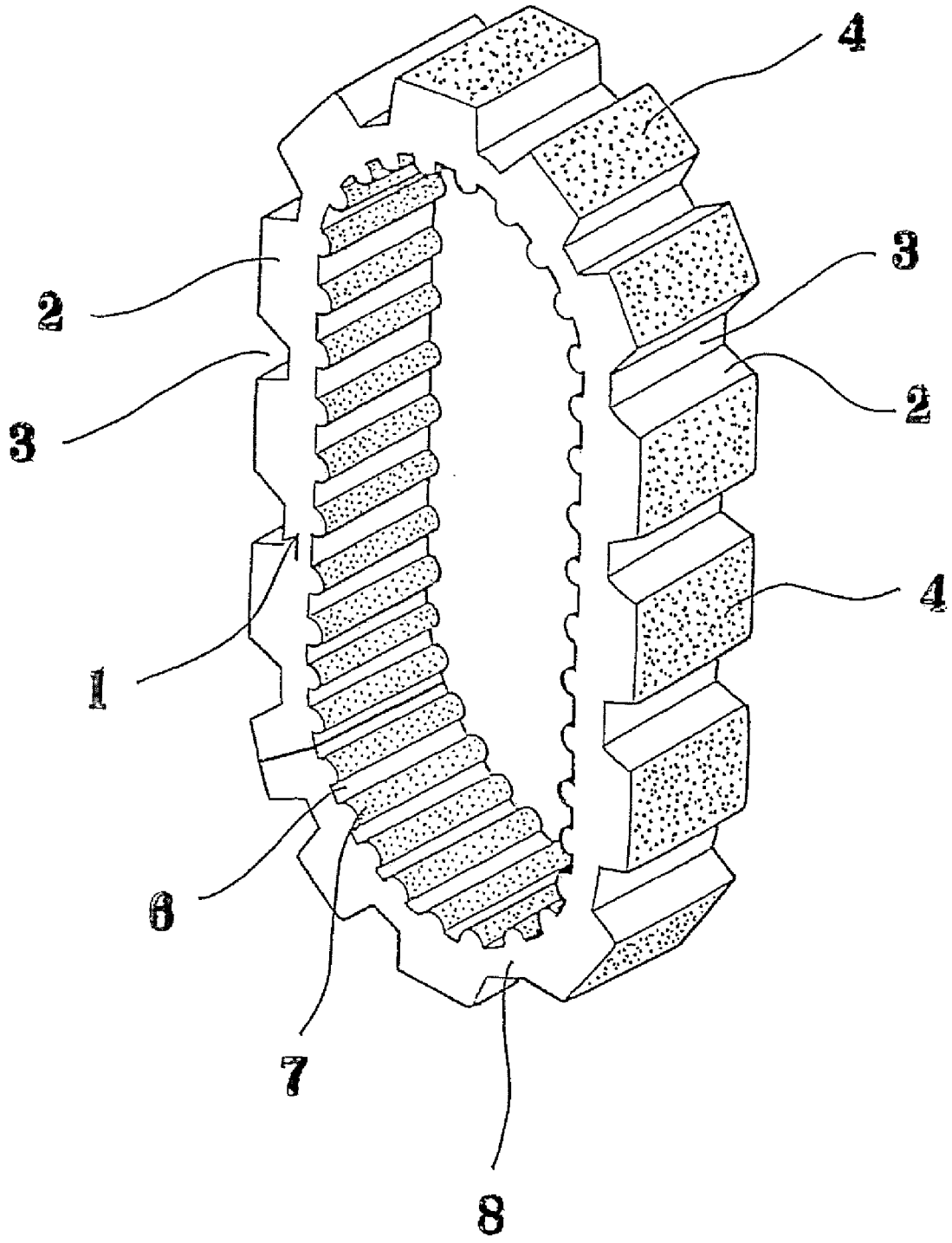
FIG. 2 is a perspective view of an endless printing belt according to an aspect of the present invention.
Figure 4:
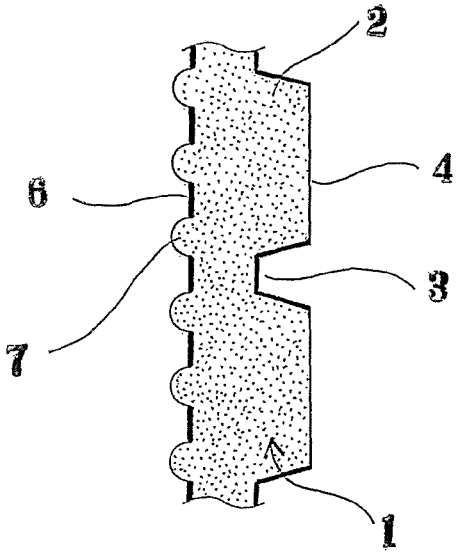
FIG. 4 is a partial cross-sectional view of the endless printing belt shown in FIG. 2 which is taken along a longitudinal direction of the belt.

FIGS. 2 and 4 show an endless printing belt of another embodiment of the present invention. In this aspect of the invention, peripheral surfaces including both side surfaces 8 of the convex portions 2, bottoms of the concave portions 3, and regions on the back surface designated by reference numeral 6 are formed into ink-impermeable portions. Meanwhile, the surfaces 4 used for the printing surface of the convex portions 2 and regions on the back surface designated by reference numeral 7 are formed into ink-permeable portions. In other words, the surfaces 4 are selectively formed into the ink-permeable portions having printing patterns by means of a post-process.

Figure 6:
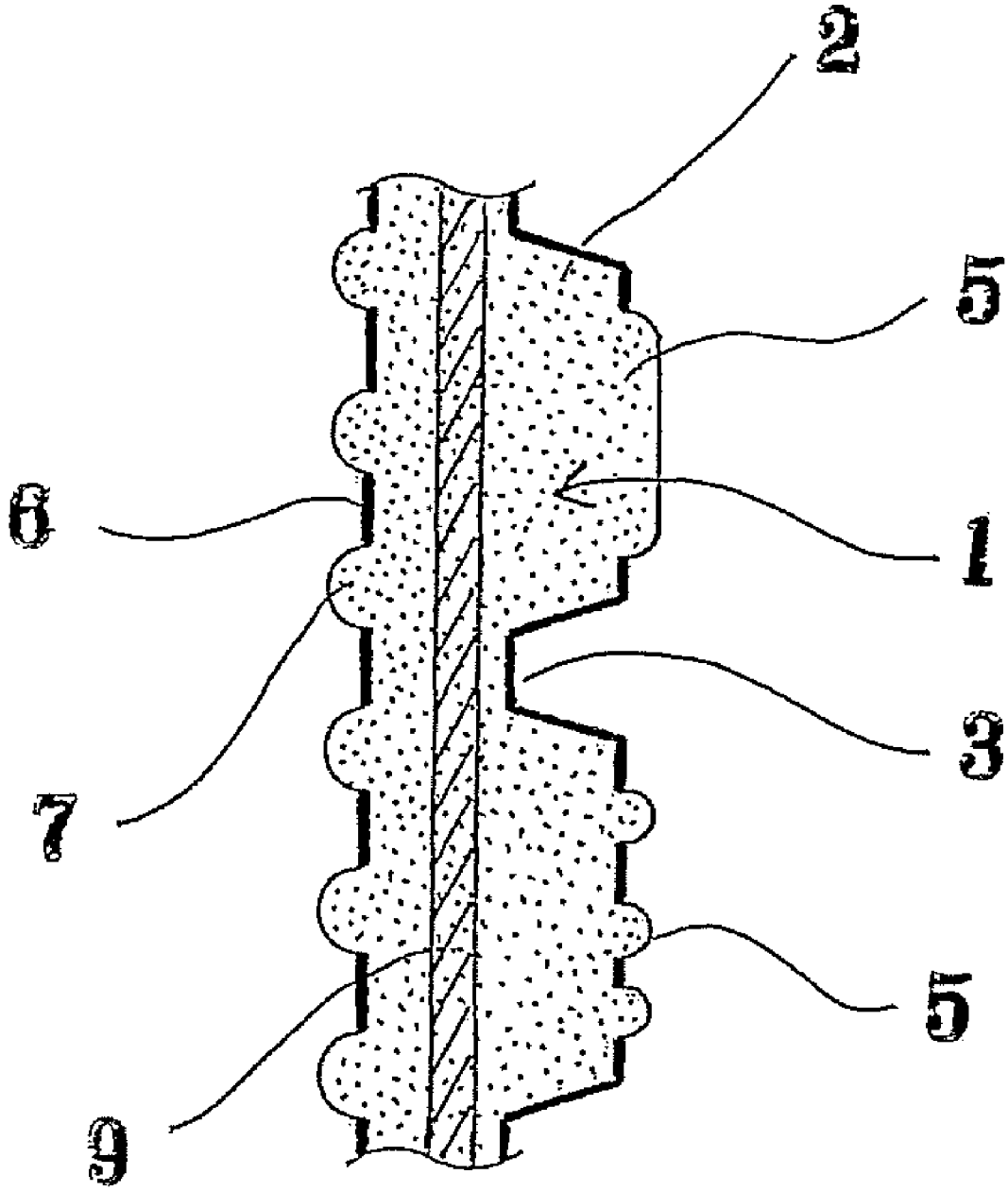
FIG. 6 is a partial cross-sectional view of an endless printing belt according to an aspect of the present invention.

Meanwhile, FIG. 6 shows the partial cross-sectional view of the endless printing belt, which interposes and integrates the sheet material.

The endless printing belt is configured to form the entire surface covering the concave portions and the convex portions into the ink-impermeable portions except for the ink-permeable printing portions 5. Accordingly, the entire surface is subjected to melt-solidification by heat.

Similarly, both of the side surfaces are also rendered ink-impermeable, which are similarly achieved by subjecting the side surfaces to melt-solidification by heat.

Next, regarding the back surface that constitutes a characteristic feature of the endless printing belt of the present invention, ink-impermeable portions 6 and ink-permeable portions 7 are alternately formed into irregular shapes. Here, the ink-impermeable portions 6 are formed by means of melt-solidification by heat into the concave portions either in a line shape or in a plane shape located substantially perpendicular to a longitudinal direction of the belt. Moreover, the ink-permeable portions 7 are formed between the ink-impermeable portions 7 in the form of convex portions.

An area of the ink-impermeable portions 6 is preferably set in a range from 30% to 70%. If the area falls below 30%, an effect to prevent volatilization is reduced. On the contrary, when the area exceeds 70%, there is a problem in light of ink supply to the surface (the printing surfaces). The area is more preferably set in a range from 40% to 60%.

Example 1

A mixture composed of the following mixture composition is put into a mixer provided with a mixing blade and is subjected to melt mixing for 20 minutes at 120° C.:

| | |
|---|---|
| copolymer of ethylene and α-olefin (softening temperature 60° C.) | 13.0 parts by weight |
| fine-grated sodium chloride | 62.8 parts by weight |
| polypropylene glycol (molecular weight 600) | 24.0 parts by weight |
| fine-grained carbon black | 0.2 parts by weight |

Subsequently, the melted mixture is formed into a sheet in a thickness of 3 mm by use of a molding machine. This sheet is processed in water at 40° C. for 20 hours and is then dried at 30° C. for 10 hours.

The sheet thus obtained has porosity of 60% and rubber hardness of 40, and includes minute interconnected cells that achieve an ink permeation period of 20 minutes. This sheet is melted and cut into a piece having a width of 9.5 mm and a length of 120 mm by use of a thermal cutter. Porous structures on the cut sections (the side surfaces of the sheet) are melted and transformed into a structure that blocks ink leakage.

The ink printing surface is formed in accordance with a flash method by placing a positive sheet on one surface (a top surface) of this sheet and then executing an irradiation process by use of an infrared lamp. This ink printing surface has a structure in which only a region where the infrared rays do not pass through is formed into an ink-leaking portion.

Next, stepped fusion-bonded portions are formed substantially perpendicularly to the longitudinal direction on the back surface of the sheet at a pitch of 2 mm by using an irregularly-shaped heat plate. Each stepped fusion-bonded portion exhibits a concave shape and constitutes the ink-impermeable portion. The area of the ink-impermeable portions occupies 60% of the entire back surface.

Subsequently, an endless printing belt is formed by heating and fusion-bonding two ends in the longitudinal direction of the sheet to each other. Concerning tension strength of the endless printing belt thus obtained, the belt of the present invention has the strength of 9.5 kg whereas an endless printing belt only provided with the printing surfaces has the strength of 4.9 kg.

Moreover, a stamp is fabricated by filling volatile ink in the belt. Then, ink volatility is compared between this stamp and a conventional stamp provided with the ink-impermeable portions only on the printing surfaces. As a result, it is confirmed that the ink volatility of the stamp is substantially reduced as compared to the conventional stamp and that an ink-usable period is extended approximately 1.5 times longer.

Meanwhile, a similar printing test and a long term test are conducted by use of non-volatile (immortal) oil-based ink. No of serious problems are observed.

Here, the concave ink-impermeable portions and the convex ink-permeable portions collectively function as a feeding and stopping mechanism of the endless printing belt. As a consequence, no slipping actions occur at the time of feeding.

On the contrary, an endless printing belt provided with the ink-impermeable portions only on the printing surfaces is apt to slip often at the time of feeding. If tension is applied to the belt in order to stop occurrence of slipping actions, the belt creeps and causes a loosening phenomenon.

Example 2

This example applies a three-layered structure (in which first and third layers are made of a thermoplastic porous material and a second layer is made of a woven fabric).

A mixture composed of the following mixture composition is put into a mixer provided with a mixing blade and is subjected to melt mixing for 20 minutes at 125° C.:

| | |
|---|---|
| copolymer of ethylene and α-olefin (softening temperature 70° C.) | 14.0 parts by weight |
| fine-grated anhydrous sodium sulfate | 61.8 parts by weight |
| polypropylene glycol (molecular weight 1500) | 24.0 parts by weight |
| fine-grained carbon black | 0.2 parts by weight |

Subsequently, the melted mixture is formed into a sheet in a thickness of 2 mm by use of an extruder. Meanwhile, a plain-woven fabric composed of 50% of polyester and 50% of polypropylene fibers (density of 50 g/m2) is prepared.

Using the woven fabric as an intermediate layer, the above-described sheet is superposed on the top and at the bottom, respectively. These constituents are fusion-molded into a three-layered sheet having a thickness of 5 mm by use of a press machine. The three-layered sheet thus obtained is completely integrated as the melted mixture penetrates the entire woven fabric.

This sheet is processed in water at 40° C. for 20 hours and is then dried at 30° C. for 10 hours.

The sheet thus obtained is a porous material having features of porosity of 57%, rubber hardness of 42, and an ink permeation period of 30 minutes. This sheet is melted and cut into a piece having a width of 20 mm and a length of 120 mm by use of a thermal cutter. Porous structures on the cut sections (the side surfaces of the sheet) are melted and transformed into a structure that blocks ink leakage.

The ink printing surface is formed in accordance with the flash method by placing the positive sheet on one surface (the top surface) of this sheet and then executing the irradiation process by use of the infrared lamp. This ink printing surface has a structure in which only the region where the infrared rays do not pass through is formed into the ink-leaking portion.

Next, stepped fusion-bonded portions are formed substantially perpendicularly to the longitudinal direction on the back surface of the sheet at a pitch of 3 mm by pressing a heat plate provided with parallel protrusions. Each stepped fusion-bonded portion exhibits a concave shape and constitutes the ink-impermeable portion. The area of the ink-impermeable portions occupies 50% of the entire back surface.

Subsequently, an endless printing belt is formed by heating and fusion-bonding two ends in the longitudinal direction of the sheet to each other.

Moreover, a stamp is fabricated by filling volatile ink in the belt. Then, ink volatility is compared between this stamp and a conventional stamp provided with the ink-impermeable portions only on the printing surfaces. As a result, it is confirmed that the ink volatility of the stamp is substantially reduced as compared to the conventional stamp and that an ink-usable period is extended approximately 1.4 times longer.

As a result of a long term test, it is confirmed that the product of the present invention is usable for a long period stably without causing loosening or deformation.

Meanwhile, a similar printing test and a long term test are conducted by use of non-volatile (immortal) oil-based ink. No serious problems are observed.

Here, the concave ink-impermeable portions and the convex ink-permeable portions collectively function as the feeding and stopping mechanism of the endless printing belt. As a consequence, no slipping actions occur at the time of feeding.

On the contrary, the endless printing belt provided with the ink-impermeable portions only on the printing surfaces is apt to slip often at the time of feeding.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion; and wherein:

the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape; and the convex portion and the concave portion on the back surface of the belt exert a slip prevention function when feeding the belt.

2. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, wherein a printing portion is provided on the printing surface; and wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape; and the convex portion and the concave portion on the back surface of the belt exert a slip prevention function when feeding the belt.

3. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape;

the convex portion and the concave portion on the back surface of the belt exert a slip prevention function when feeding the belt; and wherein an area of the ink-impermeable portion on the back surface of the belt is set in a range from 30% to 70% relative to an area of the entire back surface of the belt.

4. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, wherein an ink-permeable printing portion is formed on the printing surface; and wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape; and the convex portion and the concave portion on the back surface of the belt exert a slip prevention function when feeding the belt; and wherein an area of the ink-impermeable portion on the back surface of the belt is set in a range from 30% to 70% relative to an area of the entire back surface of the belt.

5. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, wherein a printing portion is provided on the printing surface, and wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape;

the convex portion and the concave portion on the back surface of the belt exert a slip prevention function when feeding the belt; and wherein an area of the ink-impermeable portion on the back surface of the belt is set in a range from 30% to 70% relative to an area of the entire back surface of the belt.

6. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, and wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape;

the convex portion and the concave portion on the back surface of the belt exert a slip prevention function when feeding the belt; and wherein the thermoplastic resin is a polyolefin polymer compound having a softening point equal to or below 100° C.

7. A printing apparatus comprising:

an endless printing belt comprising thermoplastic resin provided with interconnected cells;

wherein a printing surface of the belt is used for printing;

wherein a side surface of the belt is rendered ink-impermeable;

wherein a back surface of the belt comprises an ink-impermeable portion and an ink-permeable portion, and wherein the ink-impermeable portion on the back surface of the belt constitutes a concave portion in a line shape or a plane shape located substantially perpendicular to a longitudinal direction of the belt;

the ink-permeable portion constitutes a convex portion;

the back surface of the belt is formed into an irregular shape;

the convex portion and the concave portion on the back surface of the belt exert a slip prevention function when feeding the belt; and wherein a sheet material formed of a woven fabric or a nonwoven fabric is provided between and integrated with the printing surface and the back surface of the belt.

* * * * *